US006405878B1

(12) United States Patent
Graham

(10) Patent No.: US 6,405,878 B1
(45) Date of Patent: Jun. 18, 2002

(54) PLATE RAIL WITH EASILY REMOVED ARM

(76) Inventor: Norman G. Graham, 8831 S. 42nd St., Franklin, WI (US) 53132

( * ) Notice: Subject to any disclaimer, the term of this patent is extended or adjusted under 35 U.S.C. 154(b) by 0 days.

(21) Appl. No.: 09/767,475

(22) Filed: Jan. 23, 2001

(51) Int. Cl.[7] ..... A47F 7/00

(52) U.S. Cl. ..... 211/41.2; 211/41.7; 211/94.01; 211/175; 248/473

(58) Field of Search ..... 211/87.01, 85.26, 211/90.01, 94.01, 41.2, 41.7, 175, 162, 86.01, 43, 184; 248/467, 473, 453, 498, 176.1, 460, 441.1, 346.5, 476, 455, 116, 146, 161, 398, 488, 490

(56) References Cited

U.S. PATENT DOCUMENTS

| | | | | | |
|---|---|---|---|---|---|
| 490,569 | A | | 1/1893 | Lehman | |
| 679,530 | A | * | 7/1901 | Kaminski | |
| 895,211 | A | * | 8/1908 | Twitchell | |
| 905,737 | A | | 12/1908 | McCombe | |
| 906,809 | A | | 12/1908 | Lillibridge | |
| 1,215,834 | A | | 2/1917 | May | |
| 1,220,705 | A | * | 3/1917 | Tayte | |
| 2,422,261 | A | * | 6/1947 | Richards | |
| 2,454,516 | A | | 11/1948 | Laureyns | |
| D167,203 | S | * | 7/1952 | Grode | |
| 2,609,636 | A | * | 9/1952 | Stone | |
| 2,620,928 | A | * | 12/1952 | Brooks | |
| 2,886,182 | A | * | 5/1959 | Dauman | |
| 2,939,586 | A | * | 6/1960 | Dumaine | |
| 3,176,947 | A | * | 4/1965 | Inverso | |
| 3,272,183 | A | | 9/1966 | Craighead et al. | |
| 3,282,437 | A | | 11/1966 | Hansen | |
| 3,317,176 | A | * | 5/1967 | Herrin | |
| 3,999,734 | A | * | 12/1976 | Gibson et al. | 248/441.1 |
| 4,295,623 | A | * | 10/1981 | Schweizer | 248/456 |
| 4,323,214 | A | * | 4/1982 | DeLuca | 248/452 |
| 4,343,450 | A | * | 8/1982 | Anderson | 248/454 |
| 4,518,140 | A | * | 5/1985 | Ferranto | 248/456 |
| 4,592,471 | A | * | 6/1986 | Bross | 211/41.12 |
| 4,957,263 | A | | 9/1990 | Leluan | |
| 4,976,409 | A | | 12/1990 | Hansen | |
| 5,145,074 | A | | 9/1992 | Miley | |
| 6,092,676 | A | | 7/2000 | Graham | 211/94.01 |
| 6,142,315 | A | * | 11/2000 | Arout | 211/45 |
| 6,227,384 | B1 | * | 5/2001 | Saylor et al. | 211/94.01 |

* cited by examiner

*Primary Examiner*—Daniel P. Stodola
*Assistant Examiner*—Jennifer E. Novosad
(74) *Attorney, Agent, or Firm*—Andrus, Sceales, Starke & Sawall, LLP

(57) ABSTRACT

A plate rail with a base having an upstanding arm removably mounted thereto. The arm has a support position supporting the backside of a plate leaning thereagainst such that the frontside of the plate is displayed. The arm is removable from the base while the arm is in the support position by rectilinear upward withdrawal of the arm from the base. An add-on lower leg may be positioned beneath the base so that the plate rail is changed in attitude with respect to a horizontal surface on which the plate rail rests. The upstanding arm may be reversible in placement in the base so that the upstanding arm has a first orientation with regard to the base in use with the add-on leg, and a second orientation with regard to the base in use without the add-on leg.

18 Claims, 2 Drawing Sheets

PLATE RAIL WITH EASILY REMOVED ARM

BACKGROUND AND SUMMARY OF THE INVENTION

The invention relates to plate rails for displaying decorative plates on a generally horizontal surface such as the top of a cabinet or the like, for example as shown in U.S. Pat. No. 6,092,676, incorporated herein by reference.

Plate rails are known in the prior art. One type of plate rail is provided by a curb extending along the top of a cabinet, and a backstop provided by a board or the back wall. The lower edge of the plate rests on the top of the cabinet and is stopped against the front curb, and the backside of the plate leans against the backstop, board or wall, such that the frontside of the plate is displayed. The curb may have a plurality of spindles extending upwardly and supporting an upper rail for decoration.

Another type of plate rail involves a triangular support having a pair of lower curbs for stops spaced apart and engaging the lower edge of the plate, and a central backing arm engaging the backside of a plate near the top thereof. One such supporting member is needed for each plate.

The present invention provides an easy change plate rail which is particularly cost-effective and easy to install and use. The present plate rail includes a base having an upstanding arm removably mounted thereto. The arm has a support position supporting the backside of a plate leaning there against such that the frontside of the plate is displayed. The arm is movable left-right along the base so that the location of the plate may be varied along the base. The arm is removable from the base while the arm is in the support position by a simple rectilinear upward withdrawal of the arm from the base. Removal requires no left-right sliding of the arm nor forward tilting of the arm in relation to the base.

The present plate rail optionally includes an add-on lower leg positionable under a forward region of the plate rail so that the plate rail may be changed in attitude with respect to the horizontal surface. The upstanding arm may be reversible in placement in the base so that the arm has a first orientation with regard to the base in use with the add-on leg, and a second orientation with regard to the base in use without the add-on leg.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
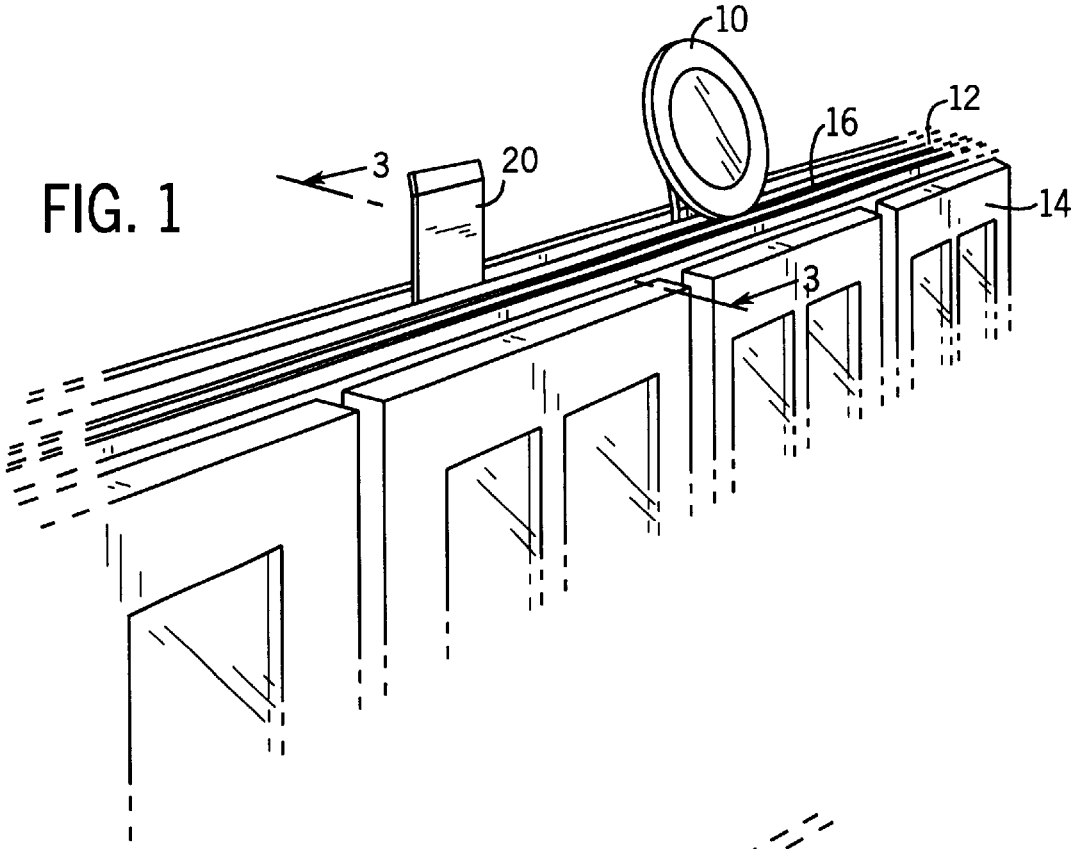
FIG. 1 is a top perspective view of plates displayed on a cabinet top.
Figure 2:
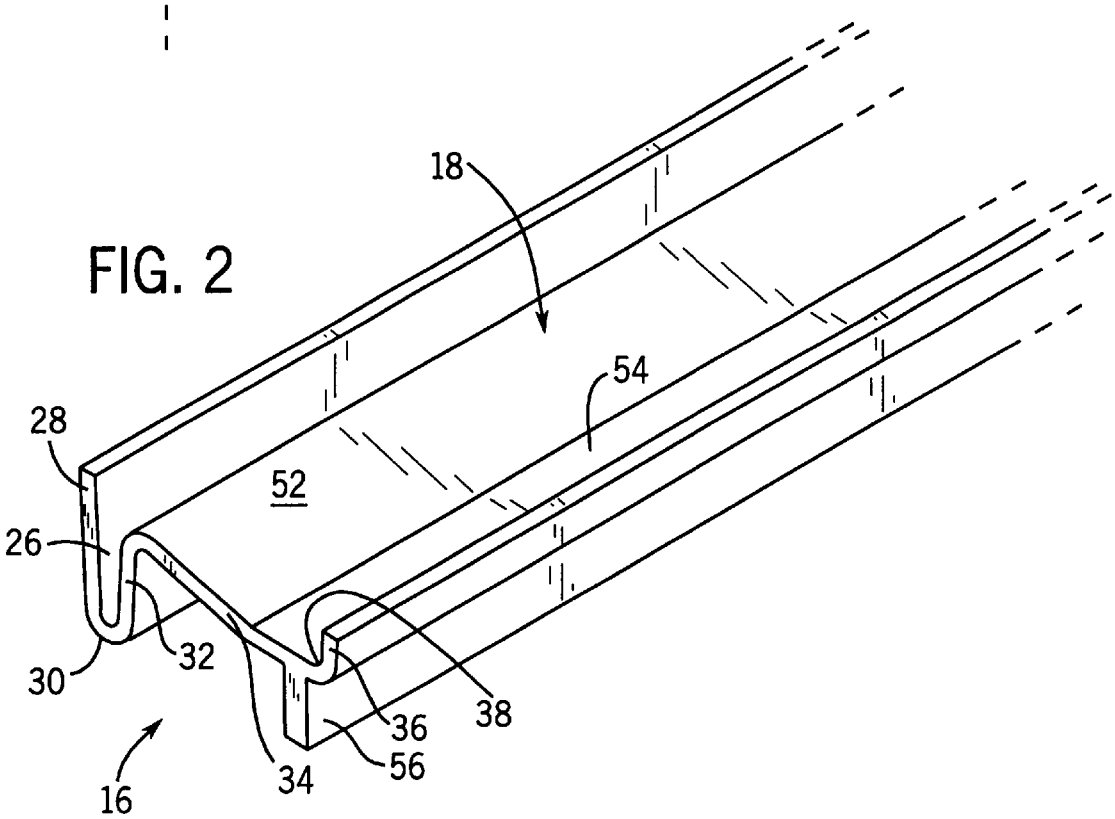
FIG. 2 is a top perspective view of a base according to the invention.

FIG. 1 shows a plate 10 supported on a generally horizontal surface 12 such as the top of a cabinet 14 or the like. A plate rail 16 is provided for supporting the plate 10 on surface 12. Plate rail 16, FIGS. 2 through 4, includes a base 18 having an upstanding arm 20 removably mounted to the base 18. The upstanding arm 20 has a support position for supporting the backside 22 of a plate leaning against the upstanding arm 20 so that the frontside 24 of a plate may be displayed. The upstanding arm 20 may be movable left-right along the base 18 so that the location of the plate along the base 18 is varied. The upstanding arm 20 is removable from the base 18 while the upstanding arm is in the support position. Specifically, the upstanding arm 20 is removable by rectilinear upward withdrawal of the upstanding arm from the base 18 without left-right sliding of the upstanding arm, and without forward tilting of the arm 20.

The base 18 has a slot 26 formed by a first downwardly extending wall 28, a second wall 30 extending forwardly from the first wall 28, and a third wall 32 extending upwardly from the second wall 30. The base 18 is further comprised by a fourth wall 34 extending forwardly from the third wall 32 and a fifth wall 36 extending upwardly from the fourth wall 34 to provide a forward stop 38. The upstanding arm 20 includes a lower section 40 received in the slot 26. The lower section 40 includes a first surface 42 extending downwardly and facing rearwardly toward the first wall 28, a second surface 44 extending forwardly from the first surface 42 and facing downwardly toward the second wall 30, and a third surface 46 extending upwardly from the second surface 44 and facing forwardly toward the third wall 32. The upstanding arm 20 further includes an upper section 48 extending upwardly from the first surface 42 and the third surface 46 beyond the first wall 28 and the third wall 32 to support a plate 10 having a lower edge 50 resting on the fourth wall 34 at a junction between the fourth wall 34 and the fifth wall 36. The forward stop 38 is provided by the junction of the fourth wall 34 and fifth wall 36. The plate 10 may rest a backside 22 against the upper section 48 of the upstanding arm 20 so that a front display side 24 of a plate 10 faces forwardly. Arm 20 is removable from slot 26 in base 16 by rectilinear upward withdrawal of the arm along a direction parallel to first and third walls 28 and 32.

The fourth forwardly extending wall 34 has a tapered ramp 52 extending forwardly and downwardly to a lower trough 54 so that a support surface may be provided to support the lower edge 50 of a plate. The fifth upwardly extending wall 36 is positioned to extend, upwardly from the lower trough 54. A top 55 of the ramp 52 is at the top of the third wall 32 and a bottom of the ramp 52 is forward of and below the top of the third wall 32 and also above the second wall 30. The lower trough 54 may be a generally horizontal surface spacing the fifth upwardly extending wall 36 forwardly of the bottom of the ramp 52.

The lower trough 54 may have a lower leg 56 adhesively bonded to and extending downwardly from the lower trough 54 for supporting the base 18 on a horizontal surface 12. The base 18 is supported on the horizontal surface 12 by second wall 30 and the lower leg 56. The lower leg 56 is spaced rearwardly of the fifth wall 36 by a gap 58 allowing clearance for a glue bead 60 at an interface of horizontal surface 12 and a front molding strip 62. The lower leg 56 is located rearward of the glue bead 60, and fourth and fifth walls 34 and 36 are above the glue bead 60.

Base 18 according to the invention has a moment arm from second wall 30 as a fulcrum to a center of mass of plate 10 and base 18. This moment arm points upwardly and forwardly from second wall 30. Slot 26 at first wall 28 is the rearmost end of base 18. The noted upwardly and forwardly pointed moment arm eliminates the need for a rearward extension of the base 18.

Fourth wall 34 has a rearward portion 64 at third wall 32 and a forward portion 66 at fifth wall 36. Forward portion 66 of fourth wall 34 is above second wall 30. Base 18 has a first position, FIG. 4, with second wall 30 and forward portion 66 of fourth wall 34 resting on horizontal surface 12. In this position, slot 26 is tilted forwardly. Base 18 has a second position, FIG. 3, with lower leg 56 provided as an add-on to forward portion 66 of fourth wall 34 and extending downwardly therefrom, with second wall 30 and leg 56 resting on horizontal surface 12. In this position, slot 26 extends generally upwardly. Plate 10 is supportable on base 18 in each of the noted first and second positions.

Figure 3:
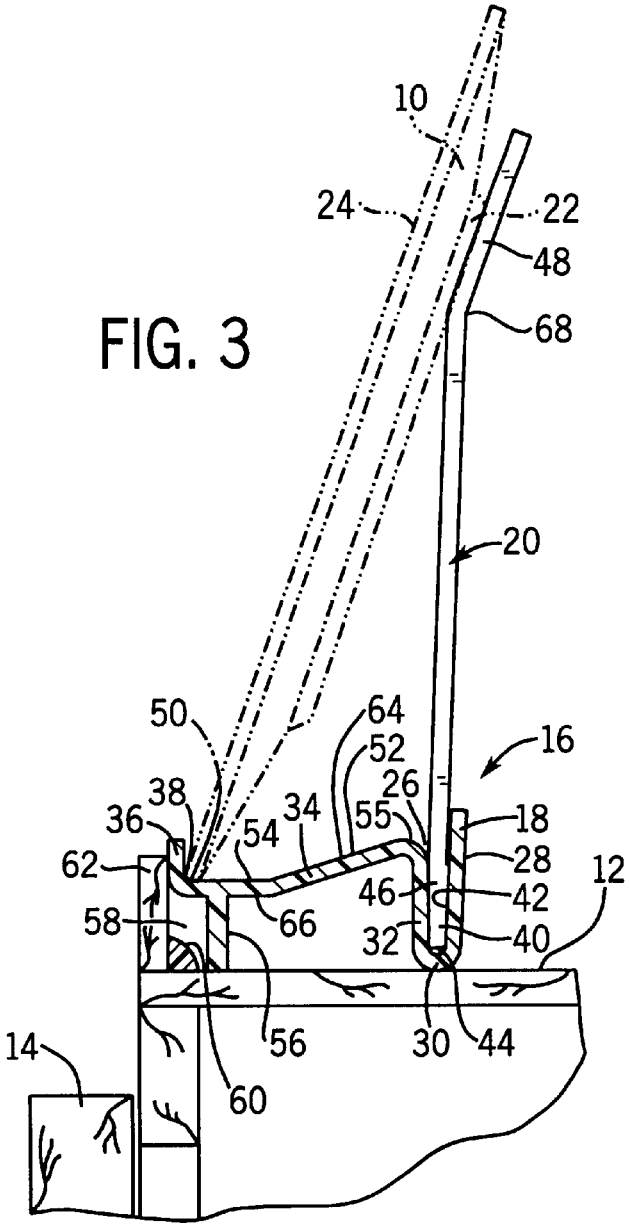
FIG. 3 is a cross-sectional view of a portion of the structure of FIG. 1 taken along line 3—3.
Figure 4:
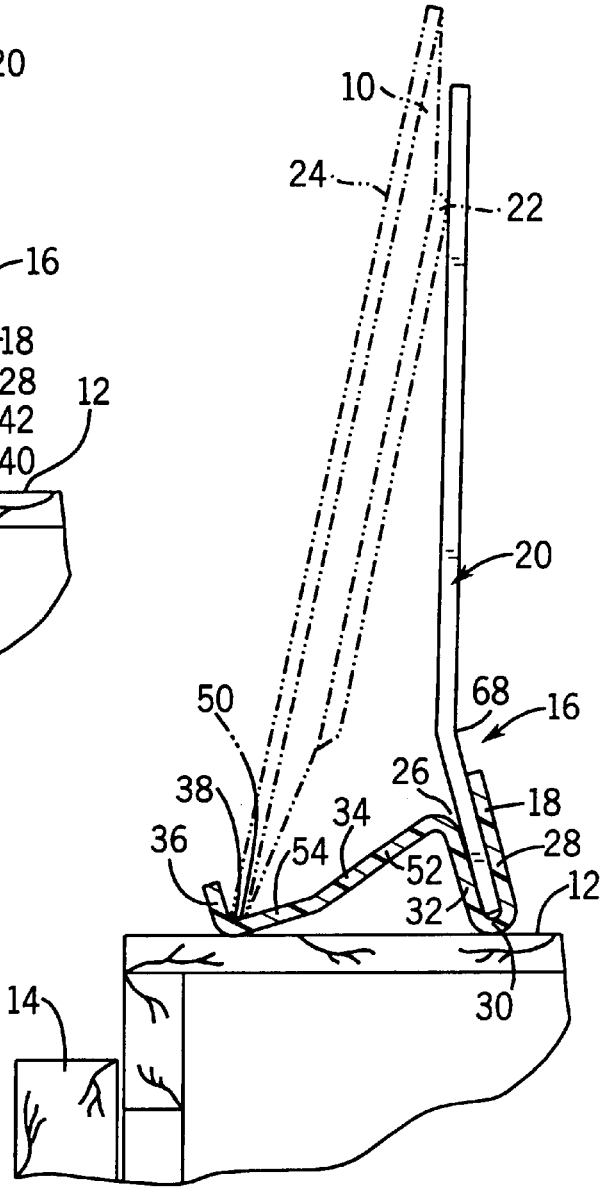
FIG. 4 is a cross-sectional view of a plate rail in an alternate positioning according to the invention.

Arm 20 is reversible between different positions. In FIG. 3, arm 20 has section 40 received in and extending along slot 26 and extending outwardly therefrom to elbow 68 and then bent rearwardly at an angle at elbow 68 and having section 48 extending at such angle therefrom. Arm 20 may be reversed in FIG. 3 such that section 48 is received in and extends along slot 26 and extends outwardly therefrom to elbow 68 and is then bent rearwardly at the noted angle at elbow 68 and has section 40 extending at such angle therefrom. Sections 40 and 48 have different lengths to provide selective plate angles relative to base 18. The noted reversibility of arm 20 may be carried out in both FIGS. 3 and 4 upon appropriate selection of the lengths of sections 40 and 48. Section 40 may be of a length relative to section 48 to compensate tilting of base 18 between the noted first and second positions.

A plate rail user may select the arrangement shown in FIG. 3 where a front molding strip 62 and associated glue bead 60 are of concern. The lower leg 56 provides that the lower edge 50 of the plate 10 may be elevated above the horizontal surface 12 so that no portion of the frontside 24 of the plate 10 will be hidden from view. Alternatively, the arrangement shown in FIG. 4 without the add-on lower leg 56 beneath the fourth wall 34 may be chosen where no intervening structure such as a front molding strip 62 may hinder viewing the frontside 24 of the decorative plate 10.

Various alternatives and embodiments are contemplated as being within the scope of the following claims particularly pointing out and distinctly claiming the subject matter regarded as the invention.

I claim:

1. A plate rail assembly for supporting a plate on a generally horizontal surface, comprising a plate rail defined by a base having an upstanding arm removably mounted thereto, said arm supporting a plate leaning thereagainst, said arm being movable along said base, wherein said arm is removable from said base while said arm is in said support position by rectilinear upward withdrawal therefrom without left or right sliding of said arm, and without forward tilting of said arm.

2. A plate rail assembly for supporting a plate on a generally horizontal surface, comprising a plate rail defined by a base having a slot formed by a first downwardly extending wall, a second wall extending forwardly from said first wall, a third wall extending upwardly from said second wall, a fourth wall extending forwardly from said third wall, and a fifth wall extending upwardly from said fourth wall and providing a forward stop; and an upstanding arm having a lower section received in said slot and having a first surface extending downwardly and facing rearwardly toward said first wall, a second surface extending forwardly from said first surface and facing downwardly toward said second wall, and a third surface extending upwardly from said second surface and facing forwardly toward said third wall, said arm having an upper section extending upwardly from said first and third surfaces beyond said first and third walls to support a plate leaning thereagainst, said arm being movable along said base.

3. The plate rail assembly according to claim 2 wherein said arm is removable from said slot in said base by rectilinear upward withdrawal therefrom along a direction parallel to said first and third walls.

4. The plate rail assembly according to claim 2 wherein said fourth wall has a tapered ramp extending forwardly and downwardly to a lower trough providing a support surface supporting said plate, said fifth wall extending upwardly from said lower trough.

5. The plate rail assembly according to claim 4 wherein said ramp extends from a top to a bottom, and said third wall extends from a top to a bottom, and wherein the top of said ramp is at the top of said third wall, and the bottom of said ramp is forward of and below the top of said third wall.

6. The plate rail assembly according to claim 5 wherein said bottom of said ramp is above said second wall.

7. The plate rail assembly according to claim 5 wherein said lower trough is a generally horizontal surface spacing said fifth wall forwardly of said bottom of said ramp.

8. The plate rail assembly according to claim 7 wherein said lower trough has a lower leg extending downwardly therefrom for supporting said base on said horizontal surface.

9. The plate rail assembly according to claim 8 wherein said base is supported on said horizontal surface by said second wall and said leg.

10. The plate rail assembly according to claim 9 wherein said leg is spaced rearwardly of said fifth wall by a clearance gap.

11. The plate rail assembly according to claim 2 wherein said fourth wall has a lower leg extending downwardly therefrom, and wherein said second wall and said leg support said base on said horizontal surface.

12. The plate rail assembly according to claim 2 wherein said base has a moment arm pointing upwardly and forwardly from said second wall as a fulcrum.

13. The plate rail assembly according to claim 12 wherein said slot at said first wall is the rearmost end of said base.

14. The plate rail assembly according to claim 2 wherein:

said fourth wall has a rearward portion at said third wall, and a forward portion at said fifth wall, said forward portion of said fourth wall being above said second wall;

said base has first and second positions;

wherein when said base is in said first position, said second wall and said forward portion of said fourth wall rest on said horizontal surface, and said slot tilts forwardly;

and wherein when said base is in said second position, a lower leg is provided as an add-on to said forward portion of said fourth wall and extends downwardly therefrom, wherein said second wall and said leg rest on said horizontal surface, and said slot extends generally upwardly; and said plate is supportable on said base in each of said first and second positions.

15. The plate rail assembly according to claim 14 wherein:

said arm has a first section received in and extending along said slot of said base in said first position and extending outwardly therefrom to an elbow and then bent rearwardly at an angle at said elbow and having a second section extending at said angle therefrom; and said arm is reversible such that said second section of said arm is received in and extends along said slot of said base in said second position and extends outwardly therefrom to said elbow from which said first section extends at said angle.

16. The plate rail assembly according to claim 15 wherein said first section of said arm is shorter than said second section of said arm to compensate tilting of said base between said first and second positions.

17. The plate rail assembly according to claim 2 wherein said arm is reversible between first and second positions, said arm in said first position having a first section received in and extending along said slot and extending outwardly therefrom to an elbow and then bent rearwardly at an angle at said elbow and having a second section extending at said angle therefrom, said arm in said second position having said second section received in and extending along said slot and extending outwardly therefrom to said elbow and then bent rearwardly at said angle at said elbow and having said first section extending at said angle therefrom.

18. The plate rail assembly according to claim 17 wherein said first and second sections have different lengths to provide selective plate angles relative to said face.

* * * * *